US011331674B2

(12) United States Patent
Vin Raviv et al.

(10) Patent No.: US 11,331,674 B2
(45) Date of Patent: May 17, 2022

(54) LIQUID MIXING

(71) Applicant: Hach Company, Loveland, CO (US)

(72) Inventors: Jordan Vin Raviv, Wellington, CO (US); Cory Scott Miller, Loveland, CO (US); Ralf Leidner, Fort Collins, CO (US); Robert Allen Luther, Fort Collins, CO (US)

(73) Assignee: HACH COMPANY, Loveland, CO (US)

( * ) Notice: Subject to any disclaimer, the term of this patent is extended or adjusted under 35 U.S.C. 154(b) by 167 days.

(21) Appl. No.: 16/397,259

(22) Filed: Apr. 29, 2019

(65) Prior Publication Data

US 2020/0338560 A1 Oct. 29, 2020

(51) Int. Cl.
*B01L 3/00* (2006.01)
*B01F 25/43* (2022.01)
(Continued)

(52) U.S. Cl.
CPC ..... *B01L 3/527* (2013.01); *B01L 3/561* (2013.01); *B01L 2300/088* (2013.01);
(Continued)

(58) Field of Classification Search
None
See application file for complete search history.

(56) References Cited

U.S. PATENT DOCUMENTS 4,756,884 A 7/1988 Hillman et al.
5,826,981 A * 10/1998 Fowler ..... B01F 5/0641 366/337
(Continued)

FOREIGN PATENT DOCUMENTS

WO 2004108261 A1 12/2004

OTHER PUBLICATIONS

International Searching Authority, Notification of Transmittal of the International Search Report and the Written Opinion of the International Searching Authority, or the Declaration, dated Aug. 10, 2020, pp. 14.

*Primary Examiner* — Matthew D Krcha
*Assistant Examiner* — Brittany I Fisher
(74) *Attorney, Agent, or Firm* — Ference & Associates LLC

(57) ABSTRACT

An embodiment provides a device for mixing at least two reagent fluids, the mixed at least two reagent fluids being used for the measurement of a chemical attribute of a sample, including: a housing; at least two inlet ports, each to receive fluid in a premix state; an outlet port to dispense fluid in a postmix state; and a surface of a lumen for mixing, located within the housing, having a predetermined length, wherein the surface of the lumen is located between the at least two inlet ports and the outlet port, wherein the at least two inlet ports transition into the surface of the lumen, wherein the predetermined length is of a length allowing for sufficient mixing of the fluids received by the at least two inlet ports, wherein the surface of the lumen comprises at least one anti-siphoning element and a plurality of weirs to create a disturbance of a fluid contained therein, wherein the at least two fluids each comprise a reagent for a measurement of a chemical attribute of a sample. Other aspects are described and claimed.

20 Claims, 5 Drawing Sheets

(51) Int. Cl.
*B01F 25/431* (2022.01)
*B01F 33/30* (2022.01)

(52) U.S. Cl.
CPC ..... *B01L 2300/0867* (2013.01); *B01L 2300/0883* (2013.01); *B01L 2300/123* (2013.01); *B01L 2300/16* (2013.01); *B01L 2400/086* (2013.01)

(56) References Cited

U.S. PATENT DOCUMENTS

| | | | | |
|---|---|---|---|---|
| 2004/0265184 | A1 | 12/2004 | Matsuda et al. | |
| 2011/0120562 | A1* | 5/2011 | Tan | G01N 33/54366 137/1 |
| 2011/0150703 | A1 | 6/2011 | Castro | |
| 2012/0263013 | A1* | 10/2012 | Xiong | B01F 13/0059 366/134 |
| 2013/0078155 | A1* | 3/2013 | Jones | B01L 3/502715 422/119 |
| 2014/0120031 | A1 | 5/2014 | Yang et al. | |
| 2018/0143174 | A1 | 5/2018 | Resh | |
| 2018/0209971 | A1 | 7/2018 | Pagels et al. | |

* cited by examiner

LIQUID MIXING

FIELD

This application relates generally to mixing liquids, and, more particularly, to mixing liquids in precise quantities at a precise time.

BACKGROUND

The proper mixture of fluids or reagents has many applications. Industrial, agricultural, food safety, pharmaceutical, chemical applications may require two or more fluids to be mixed at a given time and in a given quantity. Improperly mixing the wrong ratio of reagents may lead to poor results. Also, premixing reagents may shorten the shelf life of a mixed product which may lead to waste or problems with mixing equipment. Additionally, often times it is critical that the reagents or other fluids are thoroughly mixed together before the mixed fluid is introduced to the target product, sample, or solution.

BRIEF SUMMARY

In summary, one embodiment provides a device for mixing at least two reagent fluids, the mixed at least two reagent fluids being used for the measurement of a chemical attribute of a sample, including: a housing; at least two inlet ports, each to receive fluid in a premix state; an outlet port to dispense fluid in a postmix state; and a surface of a lumen for mixing, located within the housing, having a predetermined length, wherein the surface of the lumen is located between the at least two inlet ports and the outlet port, wherein the at least two inlet ports transition into the surface of the lumen, wherein the predetermined length is of a length allowing for sufficient mixing of the fluids received by the at least two inlet ports, wherein the surface of the lumen comprises at least one anti-siphoning element and a plurality of weirs to create a disturbance of a fluid contained therein, wherein the at least two fluids each comprise a reagent for a measurement of a chemical attribute of a sample.

Another embodiment provides a device for mixing at least two reagent fluids, the mixed at least two reagent fluids being used for the measurement of a chemical attribute of a sample, comprising: a housing; at least two inlet ports, each to receive fluid in a premix state; an outlet port to dispense fluid in a postmix state; and a surface of a lumen for mixing, located within the housing, wherein the surface of the lumen is located between the at least two inlet ports and the outlet port, wherein the at least two fluids each comprise a reagent for a measurement of a chemical attribute of a sample.

A further embodiment provides a method for mixing at least two reagent fluids, the mixed at least two reagent fluids being used for the measurement of a chemical attribute of a sample, comprising: introducing at least two fluids into a mixing device, wherein the mixing device comprises: a housing; at least two inlet ports, each to receive one of the at least two fluids in a premix state; an outlet port to dispense fluid in a postmix state; and a surface of a lumen for mixing, located within the housing, wherein the surface of the lumen is located between the at least two inlet ports and the outlet port, wherein the at least two fluids each comprise a reagent for a measurement of a chemical attribute of a sample.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
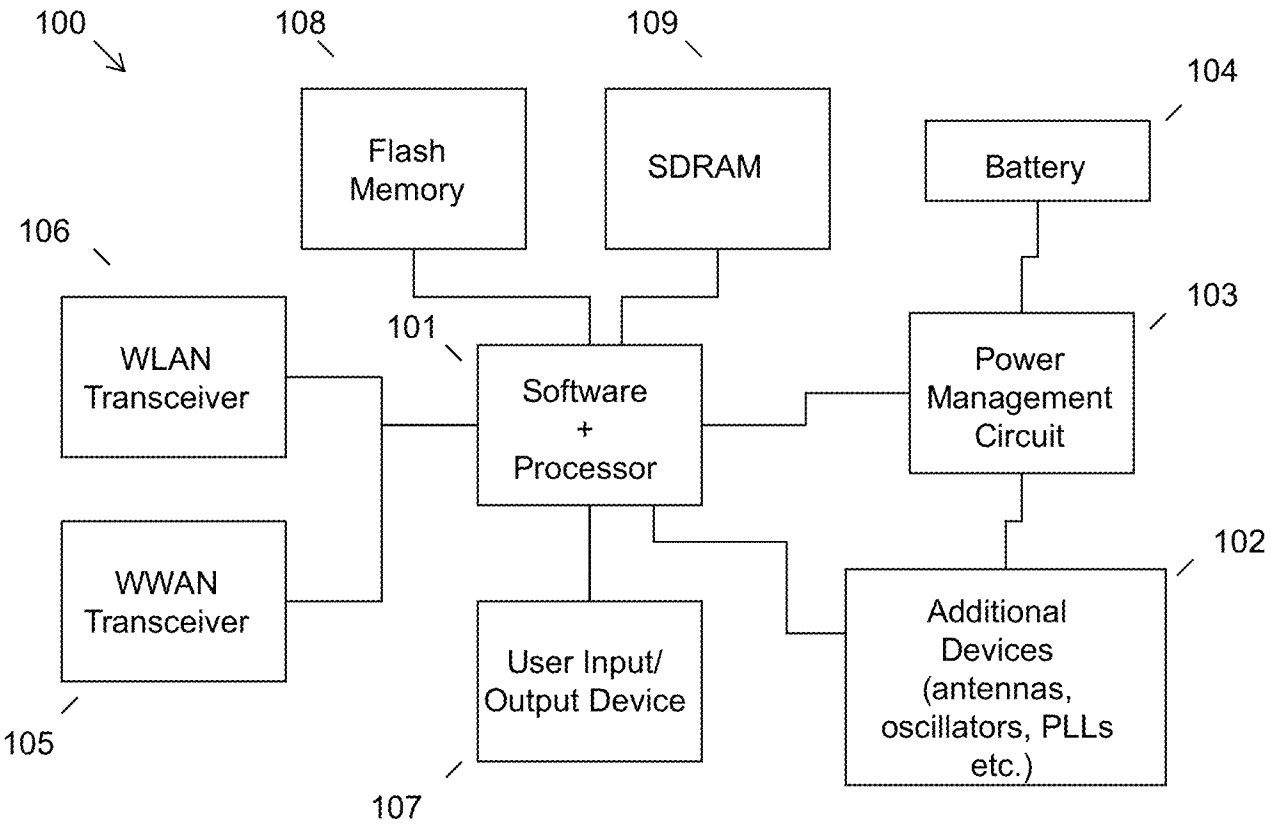
FIG. 1 illustrates an example of computer circuitry

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, appearances of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well-known structures, materials, or operations are not shown or described in detail. The following description is intended only by way of example, and simply illustrates certain example embodiments.

The mixing of reagents may have many applications. A precise mixing of reagents may be critical for the treatment of drinking water, analysis of a water sample, food safety, pharmaceuticals, industrial processes, chemical analysis, or the like. The ratio of mixed reagents may require precise delivery to ensure a properly mixed product. Also, the reagents may require a complete mixing such that the two or more reagents become completely interspersed among themselves.

Current mixing systems may use manifolds to mix reagents. In the simplest form, a manifold may simply be a "wye" fitting with two inputs to receive reagents to be mixed and one output through which the mixed reagents flow. Such manifolds have limitations. For example, a manifold may not completely mix the two or more reagents. In the "wye" example, there may exist a laminar flow of the two reagents such that the output contains two "halves" of a mixed liquid outflow component. In other words, half of the output is from a first reagent and half the output is from a second reagent since the "wye" does not allow enough fluid turbulence to properly mix the reagents.

Another limitation of manifolds may include the inability to precisely control the flow of two or more reagents to be mixed and a mixed outflow. A simple manifold may allow the flow of one or more of the reagents at a point in time when the system is not in a mixing mode of operation. For example, a system with two or more large vessels of reagents to be mixed at a "wye" may still be mixing the two or more reagents even when the outflow is cut off. There also exists the possibility of cross contamination of the two or more reagents during a non-mixing mode of the system. This cross contamination between reagents may shorten the shelf life of a reagent, contaminate the entire system, allow a chemical reaction to occur at an incorrect time point, or the like.

Mixing systems other than the "wye" example may be used to mix reagents. However, these systems have limitations as well. For example, the luminal length a reagent travels may not be consistent for all reagents, the luminal surface may be different for different reagents, there may be different fittings along each pathway, there may be different angles or bends to the reagent or different angles in which the reagents mixes into the mixed output, or the like. These parameters affect the fluid dynamics of the reagents and each reagent may undergo different fluid dynamics resulting in a imprecise or improper mixed outflow.

Accordingly, the systems and methods as described herein may properly mix two or more reagents into a mixed outflow, where the mixed outflow includes properly and thoroughly mixed fluids. In an embodiment, two or more fluids may be mixed. The device may have a housing with two or more inlet ports and an outlet port. Each of the inlet ports receives one of the premixed fluids that is to be mixed with another premixed fluid. Additionally, the housing may have a sample inlet port that allows for mixing of the sample or solution with the mixed reagents. The housing may be of a polystyrene material. In an embodiment, the housing may be constructed of two or more parts, for example, two halves, three components, or the like. The parts may be ultrasonically welded, and may have alignment tabs to ensure correct alignment of the parts when putting them together.

The lumen of the housing may receive inflow from two or more inlet ports and provide outflow through an outflow port. The lumen may have an inside diameter of approximately 1.2 mm to 1.5 mm. A luminal diameter may vary based upon the application, volume, reagents, or the like to be mixed. In an embodiment, the path of the lumen may have anti-siphoning elements. The anti-siphoning elements may be an "s" bend, and/or a "j" hook. The surface of the lumen may have weirs. The weirs may disrupt the flow of the fluid contained therein, and may create fluid turbulence, thereby facilitating mixing of the fluids. The weirs may be aligned in one or more orientations with respect to a fluid flow to provide proper mixing. In an embodiment, the mixing device may be used to mix high viscosity fluids at a low flow rate at low volumes. The mixing device may be referred to as a mixing chip because the device is used for mixing small quantities of fluids. For example, the device may be used to mix quantities of fluids that are measured in mL or μL units. The fact that the fluids are such small volumes is part of the reason conventional techniques for mixing these sizes of volumes is generally ineffective. Specifically, since the components, described in more detail below, that allow for thorough mixing of such small volumes are very small, the conventional techniques do not include these components. Thus, the described device provides a technique of mixing even very small quantities or volumes of fluid thoroughly and properly which is not possible using the conventional techniques.

The illustrated example embodiments will be best understood by reference to the figures. The following description is intended only by way of example, and simply illustrates certain example embodiments.

While various other circuits, circuitry or components may be utilized in information handling devices, with regard to an instrument for fluid mixing according to any one of the various embodiments described herein, an example is illustrated in FIG. 1. Device circuitry 100 may include a measurement system on a chip design found, for example, a particular computing platform (e.g., mobile computing, desktop computing, etc.) Software and processor(s) are combined in a single chip 101. Processors comprise internal arithmetic units, registers, cache memory, busses, I/O ports, etc., as is well known in the art. Internal busses and the like depend on different vendors, but essentially all the peripheral devices (102) may attach to a single chip 101. The circuitry 100 combines the processor, memory control, and I/O controller hub all into a single chip 110. Also, systems 100 of this type do not typically use SATA or PCI or LPC. Common interfaces, for example, include SDIO and I2C.

There are power management chip(s) 103, e.g., a battery management unit, BMU, which manage power as supplied, for example, via a rechargeable battery 104, which may be recharged by a connection to a power source (not shown). In at least one design, a single chip, such as 101, is used to supply BIOS like functionality and DRAM memory.

System 100 typically includes one or more of a WWAN transceiver 105 and a WLAN transceiver 106 for connecting to various networks, such as telecommunications networks and wireless Internet devices, e.g., access points. Additionally, devices 102 are commonly included, e.g., a transmit and receive antenna, oscillators, PLLs, etc. System 100 includes input/output devices 107 for data input and display/rendering (e.g., a computing location located away from the single beam system that is easily accessible by a user). System 100 also typically includes various memory devices, for example flash memory 108 and SDRAM 109.

It can be appreciated from the foregoing that electronic components of one or more systems or devices may include, but are not limited to, at least one processing unit, a memory, and a communication bus or communication means that couples various components including the memory to the processing unit(s). A system or device may include or have access to a variety of device readable media. System memory may include device readable storage media in the form of volatile and/or nonvolatile memory such as read only memory (ROM) and/or random access memory (RAM). By way of example, and not limitation, system memory may also include an operating system, application programs, other program modules, and program data. The disclosed system may be used in an embodiment to perform fluid mixing of two or more reagents. For example, the device of FIG. 1 may be used by an analyzer, mixing instrument, of the like, that contains or is coupled to the mixing device described herein. For example, the mixing device described herein may be connected to a measurement device that utilizes the circuitry of FIG. 1.

Figure 2:
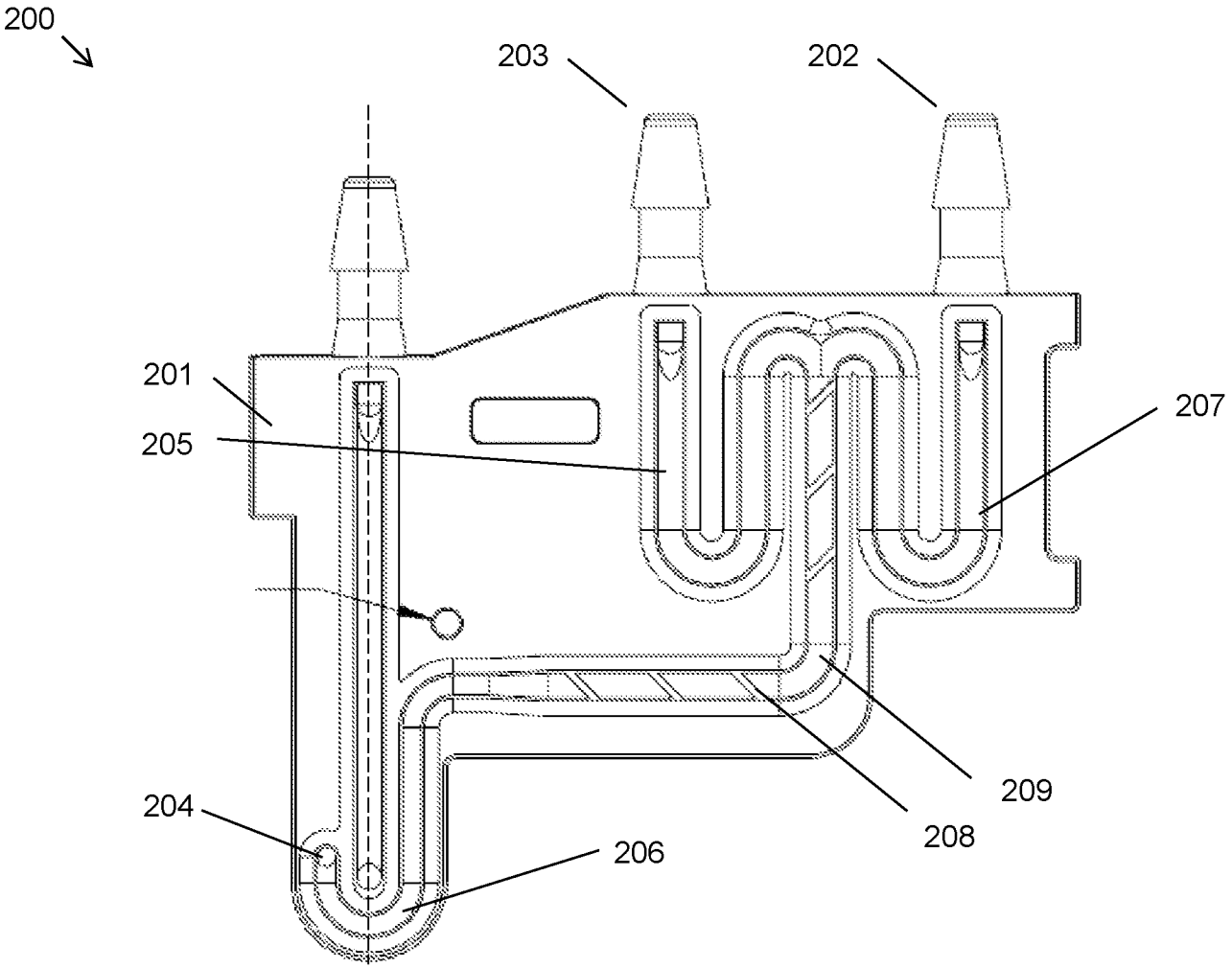
FIG. 2 illustrates an example internal cutaway view of a fluid mixing device.
Figure 3:
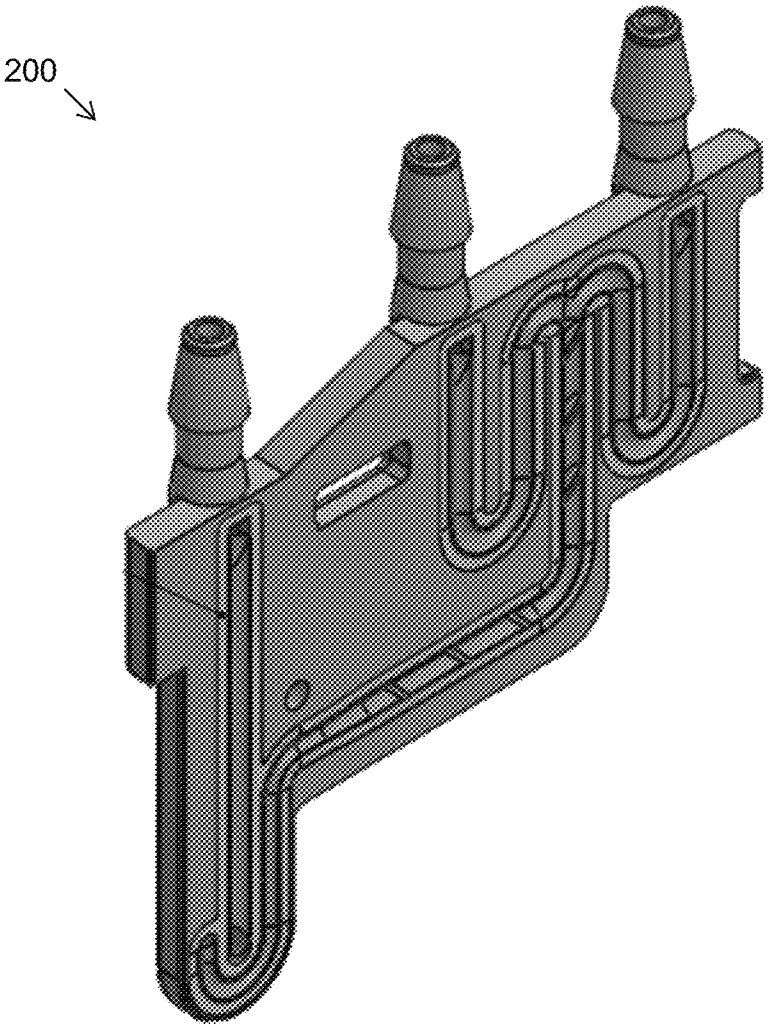
FIG. 3 illustrates another example internal cutaway view of a fluid mixing device.

Referring now to FIG. 2, an embodiment may mix two or more reagents in a mixing device 200. In an embodiment, the device 200 may include a housing 201. Also, FIG. 3 illustrates another example view of the mixing device 200. In order to see the components of the mixing device 200 both FIG. 2 and FIG. 3 illustrate a cut-away view revealing the inside of the mixing device 200. Referring back to FIG. 2, the housing 201 may be a single piece or be constructed of two or more pieces. In this example, the cut-away view of FIG. 2 illustrates one half of the mixing device 200. However, the mixing device 200 may be created from more than two pieces. The housing may be made of a polystyrene material. In an embodiment, the housing may be of or about 96% polystyrene and of or about 4% black pigment. Other materials and pigments are contemplated and disclosed. For example, the housing 201 may be made of metal, other types of plastic, or any other material or composition of materials that are impermeable to liquid and/or gas. Additionally, the chosen material may be chemical resistant in order to reduce erosion or degradation of the mixing device 200.

In an embodiment, the device may have two or more inlet ports 202 and 203. The number of inlet ports may be selected based upon the number of reagents or components to be mixed. The reagents prior to mixing may be referred to as a premix state. Premixed simply refers to a starting form of the fluid before being introduced into the mixing device 200. Thus, the premixed fluid may actually be a postmixed fluid containing one or more fluids that were mixed before introduction into the mixing device 200. In other words, the term "premix" refers to the fluid with respect to the mixing device and not the composition of the fluid being introduced into the one or more inlet ports. The premix fluid is simply the fluid being introduced into one or more of the inlet ports 202 and 203. The housing may also contain an outlet port 204. The outlet port may be an outflow from the housing and contain fluid from the housing which may contain the reagents from the inlet ports. The fluid from the outlet port 204 may be referred to as a postmix state. Again, the term "postmix" refers to the state of the fluid with respect to the mixing device and not the composition of the fluid being discharged from the outlet port 204. The postmix fluid is a mixed composition of the premix fluids that were introduced to the inlet ports 202 and 203. As an example, the reagents for the Hach CL17 Chlorine Analyzer (available from Hach Company of Loveland, Colo.) may be mixed. The CL17 reagents may combine an acid and a base to form a buffer. A DPD (N, N-diethyl-p-phenylene-diamine) indicator may be mixed into an acid reagent to keep the acid reagent stable. The device may mix fluid of both a range and differing viscosities. For example, a base reagent may be 4-6 s/cm$^2$, and an acid reagent may be approximately 1.5 s/cm$^2$. A fluid for mixing may have a Reynolds number in the approximate range of 500-5000 Re. Although chlorine analysis is used as an exemplar, the methods and devices described herein may be used for the mixing of any fluid for any application. The mixing may be performed on reagents for any measurement of a chemical parameter of characteristic.

In an embodiment, there is a lumen 205 created by a surface of a passageway 209 for fluid between the at least two inlet ports and the outlet port. The lumen may be a space enclosed by the surface of the pathway between the inlet ports 202 and 203 and the outlet port 204. The passageway 209 may be of a predetermined length. The predetermined length may be of a length long enough to allow proper mixing of the premix fluids to a postmix state. In other words, the passageway 209 may be long enough to allow for thorough mixing of the premix fluids that are introduced to the two or more inlet ports 202 and 203 before being discharged at the outlet port 204. The predetermined length may be based upon the quantity of fluid to be mixed. In other words, if a greater quantity of fluid is to be mixed, then the predetermined length may be longer in order to ensure proper and thorough mixing of the quantity of fluid. The surface of the lumen 205 may be of any directional shape to ensure proper mixing of reagents to a postmix state. Thus, the surface of the lumen 205 may have more or less curves, bends, or other features than those shown in FIG. 2.

In an embodiment, the surface of the lumen 205 may have one or more anti-siphoning elements. The anti-siphoning element may be a "j" hook 206 and/or an "s" bend 207. Other anti-siphoning elements 206 or 207 are possible and contemplated. Additionally, the mixing device 200 may contain more or fewer anti-siphoning elements 206 or 207 than are illustrated in FIG. 2. In an embodiment, an anti-siphoning element 206 or 207 allows fluid to flow in only one direction. An anti-siphoning element 206 or 207 may also prevent the backflow of a reagent. Prevention of backflow may prevent cross contamination between reagents or between premix and postmix states. Cross contamination may shorten the shelf life of reagents. For example, some applications require the mixing of two reagents to start a process, and contamination of a reagent with another reagent or with a postmix state fluid may shorten the shelf life of a reagent, hinder a reaction, or contaminate the entire mixing device. Anti-siphoning may also limit staining to tubing or other places where fluid comes into contact with the device.

In an embodiment, the surface of the lumen may have protuberances. In an embodiment, the protuberances may be referred to as weirs 208. In an embodiment, the weirs 208 may stick out from the surface of the lumen toward the fluid contained therein. In other words, the weirs 208 may be projections from the surface of the lumen 205 into the fluid passageway. The weirs 208 may be on an angle. For, example the weirs 208 may be aligned on an angle with respect to the direction of flow of a fluid contained therein. The weirs 208 may be in any orientation to disrupt fluid flow and create fluid turbulence of the fluid contained therein. Thus, the weirs 208 facilitate mixing of the fluids contained therein. In an embodiment, weirs 208 may have different orientations from one another. For example, the weirs 208 may be oriented in a cross or x-like manner with respect to each other to facilitate generation of fluid turbulence and, therefore, facilitate thorough mixing of the fluid. The weirs may crisscross the lumen. The weirs may be at an angle of 45 degrees with respect to a flow of liquid in the lumen. The weirs may be approximately 0.4 mm thick. The thickness may be measured from the surface of the lumen to a height a weirs projects toward the center of the lumen. The weirs may be spaced evenly from one another or in any spacing pattern. The weirs may be placed at a spacing of approximately 3 weirs per 10 mm of luminal longitudinal distance. In an embodiment, there may be approximately 6 weirs per side of the housing.

Figure 4:
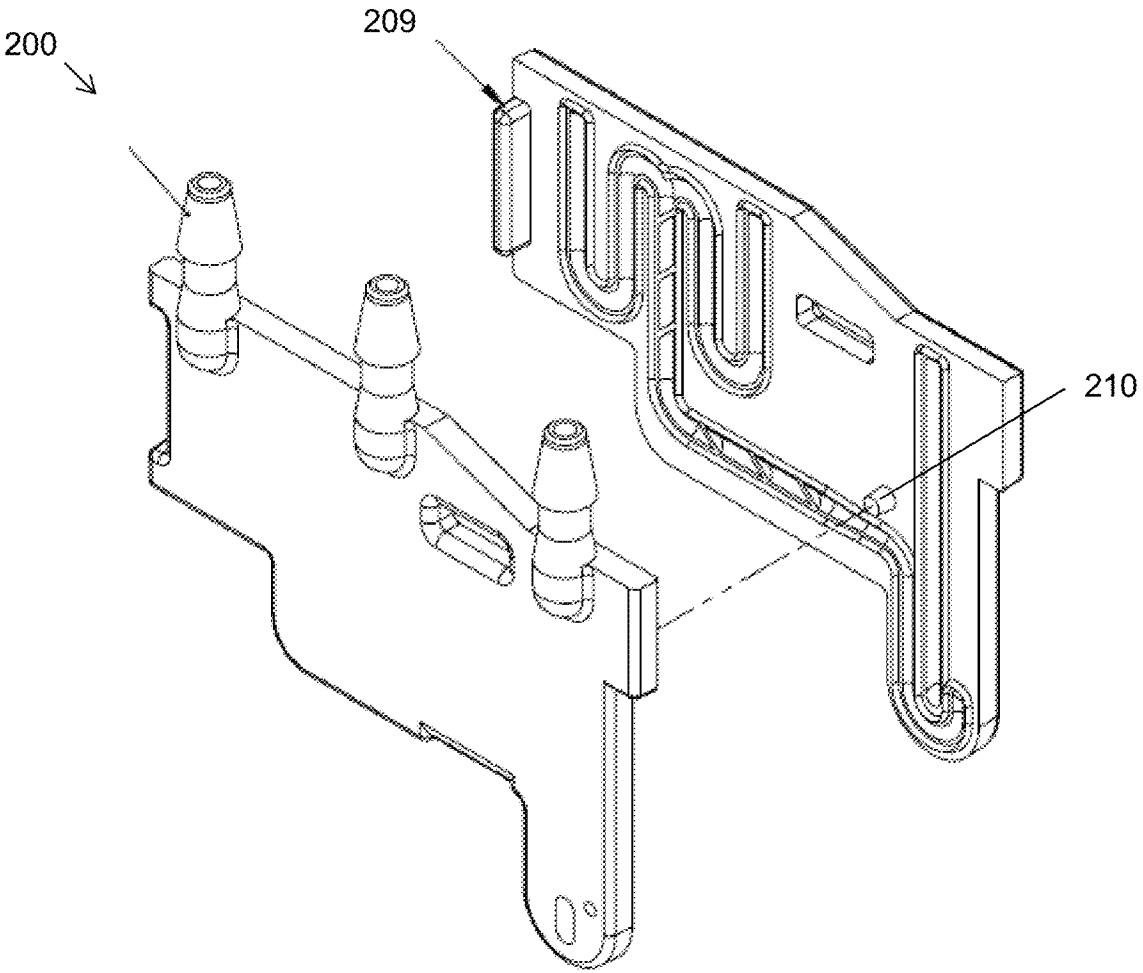
FIG. 4 illustrates an example assembly view of a fluid mixing device.
Figure 5:
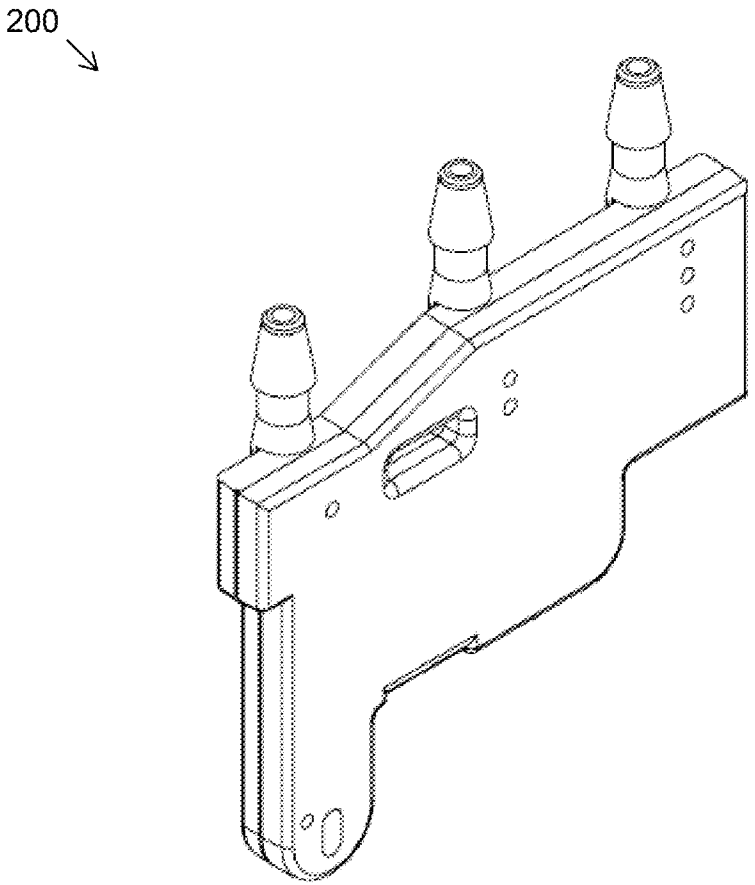
FIG. 5 illustrates an example assembled view of a fluid mixing device.

Referring to FIG. 4, the mixing device 200 housing 201 may be constructed of two or more pieces. The housing may be constructed from two halves ultrasonically welded together. The two or more pieces may have alignment tabs 209 and 210. The alignment tabs may be ridges, pins, tabs, or the like. The alignment tabs may fit into a complimentary portion of another piece of the housing, for example, the other piece of the housing may have a slot, hole, or other feature, for receiving the alignment tabs 209 and 210. In an embodiment, the weirs on one half may have a first orientation and the weirs on the second half may have a second orientation, for example, thereby making an x or cross when the two halves are joined. Additionally or alternatively, one of the multiple pieces of the housing may have weirs in different orientations with the other pieces having no weirs. FIG. 5 illustrates an example assembled mixing device 200.

In an embodiment, the mixing device may be operatively coupled to the components illustrated in FIG. 1. For example, a system may control the flow of reagents in a premix state to be mixed and outflow of postmix state fluid. The flow may be controlled by processors, pumps, tubing, valves, and the like. A flow control system may be coupled to a system that measures parameters such as an online chlorine analyzer, analyte concentration, pH, temperature, salinity, turbidity, pressure, or the like. A parameter may lead to a change in flow of the mixing device. The system may output a parameter to a user, system, storage, database, or the like. The system may also output an alarm for flow rate, premix reagent levels, postmix levels, mixing device maintenance issues, or the like.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device, where the instructions are executed by a processor. In the context of this document, a storage device is not a signal and "non-transitory" includes all media except signal media.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and products according to various example embodiments. It will be understood that the actions and functionality may be implemented at least in part by program instructions. These program instructions may be provided to a processor of a device, e.g., a measurement device such as illustrated in FIG. 1, or other programmable data processing device to produce a machine, such that the instructions, which execute via a processor of the device, implement the functions/acts specified.

It is noted that the values provided herein are to be construed to include equivalent values as indicated by use of the term "about." The equivalent values will be evident to those having ordinary skill in the art, but at the least include values obtained by ordinary rounding of the last significant digit.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A device for mixing at least two reagent fluids, the mixed at least two reagent fluids being used for the measurement of a chemical attribute of a sample, comprising:

a housing, the housing comprising a first half and a second half;

at least two inlet ports, each to receive fluid in a premix state;

an outlet port to dispense fluid in a postmix state; and a surface of a passageway creating a lumen for mixing, the lumen located within the housing and having a predetermined length, wherein the passageway creating the lumen is located between the at least two inlet ports and the outlet port, wherein the at least two inlet ports transition into the surface of the passageway, wherein the predetermined length is of a length allowing for sufficient mixing of the fluids received by the at least two inlet ports, wherein the surface of the passageway comprises at least one anti-siphoning element and a plurality of weirs extending from the surface of the passageway into the lumen to create a disturbance of a fluid contained therein, wherein the anti-siphoning element comprises at least one 180 degree bend placed prior to a point of mixing the at least two fluids, wherein a portion of the plurality of weirs have a first orientation aligned to rotate the at least two fluids about their longitudinal flow in a first direction on the first half and another portion of the plurality of weirs have a second orientation aligned to rotate the at least two fluids about their longitudinal flow in a second direction on the second half, wherein the at least two fluids each comprise a reagent for a measurement of a chemical attribute of a sample.

2. A device for mixing at least two reagent fluids, the mixed at least two reagent fluids being used for the measurement of a chemical attribute of a sample, comprising:

a housing, the housing comprising a first half and a second half;

at least two inlet ports, each to receive fluid in a premix state;

an outlet port to dispense fluid in a postmix state; and a surface of a passageway creating a lumen for mixing, the lumen located within the housing, wherein the passageway creating the lumen is located between the at least two inlet ports and the outlet port, wherein the surface of the passageway comprises at least one anti-siphoning element and a plurality of weirs extending from the surface of the of the passageway into the lumen to create a disturbance of a fluid contained therein, wherein the anti-siphoning element comprises at least one 180 degree bend placed prior to a point of mixing the at least two fluids, wherein a portion of the plurality of weirs have a first orientation aligned to rotate the at least two fluids about their longitudinal flow in a first direction on the first half and another portion of the plurality of weirs have a second orientation aligned to rotate the at least two fluids about their longitudinal flow in a second direction on the second half, wherein the at least two fluids each comprise a reagent for a measurement of a chemical attribute of a sample.

3. The device of claim 2, wherein the housing comprises a material impermeable to a gas and a liquid.

4. The device of claim 2, wherein the housing comprises a polystyrene material.

5. The device of claim 2, wherein the housing comprises at least two pieces ultrasonically welded together.

6. The device of claim 5, wherein the at least two pieces comprise at least one complementary alignment tab.

7. The device of claim 2, wherein the surface of the lumen comprises at least one anti-siphoning element.

8. The device of claim 7, wherein the at least one anti-siphoning element is an "s" bend.

9. The device of claim 7, wherein the at least one anti-siphoning element is a "j" hook.

10. The device of claim 2, wherein the surface of the lumen comprises a plurality of weirs to create a disturbance of a fluid contained therein.

11. The device of claim 10, wherein the plurality of weirs are positioned in at least two different orientations with respect to a flow of the fluid contained therein.

12. A method for mixing at least two reagent fluids, the mixed at least two reagent fluids being used for the measurement of a chemical attribute of a sample, comprising:

introducing at least two fluids into a mixing device, wherein the mixing device comprises:

a housing, the housing comprising a first half and a second half;

at least two inlet ports, each to receive at least one of the two fluids in a premix state;

an outlet port to dispense fluid in a postmix state; and a surface of a passageway creating a lumen for mixing, the lumen located within the housing, wherein the passageway creating the lumen is located between the at least two inlet ports and the outlet port, wherein the surface of the passageway comprises at least one anti-siphoning element and a plurality of weirs extending from the surface of the passageway into the lumen to create a disturbance of a fluid contained therein, wherein the anti-siphoning element comprises at least one 180 degree bend placed prior to a point of mixing the at least two fluids, wherein a portion of the plurality of weirs have a first orientation aligned to rotate the at least two fluids about their longitudinal flow in a first direction on the first half and another portion of the plurality of weirs have a second orientation aligned to rotate the at least two fluids about their longitudinal flow in a second direction on the second half, wherein the at least two fluids each comprise a reagent for a measurement of a chemical attribute of a sample.

13. The method of claim 12, wherein the housing comprises a material impermeable to a gas and a liquid.

14. The method of claim 12, wherein the housing comprises a polystyrene material.

15. The method of claim 12, wherein the housing comprises at least two pieces ultrasonically welded together.

16. The method of claim 15, wherein the at least two pieces comprise at least one complementary alignment tab.

17. The method of claim 12, wherein the surface of the lumen comprises at least one anti-siphoning element.

18. The method of claim 17, wherein the at least one anti-siphoning element is an "s" bend.

19. The method of claim 17, wherein the at least one anti-siphoning element is a "j" hook.

20. The method of claim 12, wherein the surface of the lumen comprises a plurality of weirs to create a disturbance of a fluid contained therein.

* * * * *